United States Patent [19]

Scholfield

[11] 3,936,112

[45] Feb. 3, 1976

[54] CRADLE SELECTOR CONTROLS FOR MOTORIZED ROTARY FILES

[75] Inventor: Richard P. Scholfield, Peekskill, N.Y.

[73] Assignee: Presto Lock Company, Division of Walter Kidde & Company, Inc., Clifton, N.J.

[22] Filed: Oct. 10, 1974

[21] Appl. No.: 513,545

[52] U.S. Cl. ..... 312/267; 312/223

[51] Int. Cl.[2] ..... A47B 49/00; D06H 3/02

[58] Field of Search ..... 312/223, 267, 268; 346/1 D, 33 F; 214/11; 209/111.8, 122–124; 5/66, 68

[56] References Cited

UNITED STATES PATENTS

| | | | |
|---|---|---|---|
| 2,873,159 | 2/1959 | Becker | 312/223 |
| 2,928,706 | 3/1960 | Abbott et al. | 312/223 |
| 3,428,384 | 2/1969 | Goldhammer | 312/223 |
| 3,798,684 | 3/1974 | Benoit | 5/68 |

*Primary Examiner*—Casmir A. Nunberg

*Attorney, Agent, or Firm*—Haven E. Simmons; James C. Nemmers

[57] ABSTRACT

The cradle selector controls of a motorized rotary-type file comprise a row of simple, momentary-type pushbutton switches located in a small housing mounted so as to slide along the rear edge of the operator's shelf. The control housing is connected to the file where all other controls are located by an electrical cable, whereby the selector controls can be readily moved back and forth with the operator.

3 Claims, 5 Drawing Figures

CRADLE SELECTOR CONTROLS FOR MOTORIZED ROTARY FILES

BACKGROUND OF THE INVENTION

Power driven rotary files are well known. Typically these employ a number of elongated cradles which are horizontally suspended between and about the peripheries of a pair of spaced traveling devices which are driven so that the cradles are presented one by one before the operator who normally sits at a table or shelf at the front of the file. Some means of course for selecting the cradles one by one is necessary. These are generally essentially electrical in nature and are typically operated by a layout of buttons, one for each cradle, disposed at some location on the front of the file. Usually the files are quite wide and the operator must move bodily back and forth across the front of the file for access to different portions of a cradle. If the location of the selector controls is fixed, the operator, owing to the width of the cradle, often must move bodily sideways in order just to reach the controls so that a new cradle can be selected and then back again for access to the desired position of the new cradle. Even when the controls are mounted in some manner at some intermediate position between the ends of the file, the operator often must still reach to one side for them with one hand or the other. Furthermore, when the controls are mounted at some intermediate position, which is usually on the shelf itself at the center, they are often in the operator's way, requiring him to work over the controls and to move work papers each time access to the controls is necessary.

U.S. Pat. No. 2,928,706 discloses a movable set of selector controls for files of the nature concerned in the form of a telephonelike dial selector at the end of a flexible electrical cable, the dial being mounted in a loose housing free to be slid about by the operator on the shelf before the file. A somewhat similar approach, in the case of card selection apparatus, is shown in U.S. Pat. No. 2,922,424. However, in the latter instance, the movable controls, though movable along a fixed track, are both bulky and complicated. In the former instance the dial selector, though much less bulky. is relatively complex, costly and slow, and since it is loose on the shelf, can easily be knocked off. Hence, the primary object of the present invention is the provision of movable cradle selector controls for motorized rotary files which are simple, inexpensive, small in bulk, do not interfere with the operator, and cannot be knocked off the shelf.

SUMMARY OF THE INVENTION

The crade selector controls of the present invention are relieved of all but the minimum of electrical function and mechanical detail, consequently reducing their cost, complexity and bulk. Simple, momentary contact-type pushbuttom switches, plus a connecting cable, is all the electrical and mechanical apparatus embodied in the movable controls themselves, the circuit latching mechanism usually employed with the selector controls being placed in the file itself. In the case of the present invention, reed-type vacuum relays are used in the latching circuits so as to reduce to a minimum the current through the controls and the size of the pushbutton switches and wiring. The pushbutton switches themselves are placed in a row along the top of a small metal housing which is secured along the rear of the operator's shelf for slidable movement along a fixed track. The result is a selector control not only much simpler than the dial type but also much faster in operation, and one which is readily movable with the operaor to whatever position across the file is desired. By the same token the control can be easily pushed aside so that it does not interfere with the operator's work papers, and yet cannot be knocked off the shelf. Other features and advantages of the present invention will become apparent from the more detailed description which follows and the drawings.

DETAILED DESCRIPTION OF THE PREFERRED EMBODIMENT

Figure 1:
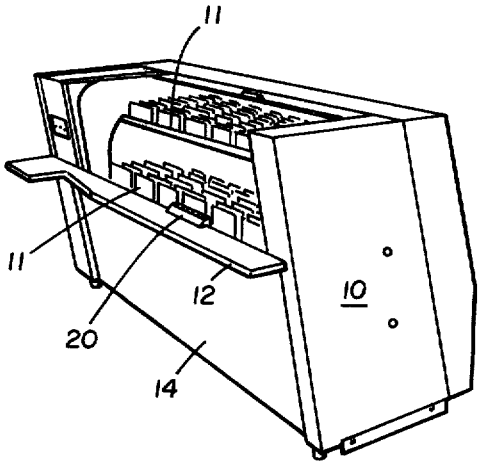
FIG. 1 is an isometric overall view of a power driven rotary file of the type with which the present invention is concerned.
Figure 2:
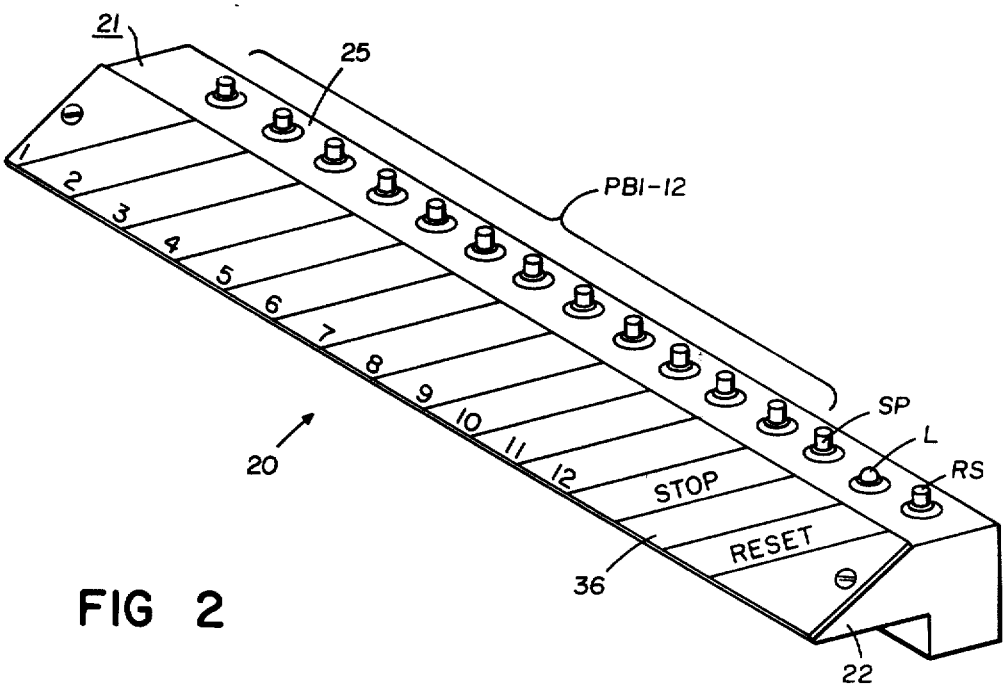
FIG. 2 is an enlarged isometric view of the movable selector controls employed with the file of FIG. 1.

The typical motorized rotary file, as shown in FIG. 1, includes an overall housing 10 which encases a number of horizontally suspended cradles 11 for carrying records. As is well known, the cradles 11 are interconnected and power driven by an appropriate electric motor so that selected cradles 11 are, at the command of the operator, presented just to the rear of a wide shelf 12 across the front of the housing 10 before which the operator sits and which is supported on brackets 13 attached to a front wall 14 of the housing 10. As a cradle 11 is brought into position before the operaor, he moves back and forth along the shelf 12 for access to records at various locations in the cradle 11 before him. As he does so, he moves with him the cradle selector controls, generally indicated at 20, so that at all times the latter are readily at hand for selection of additional cradles 11 without the operator having also to move to one end of the housing 10 each time a new cradle 11 is to be selected, as is customarily the case with present such files in which the location of such controls is fixed, usually at one end or in the middle.

Figure 3:
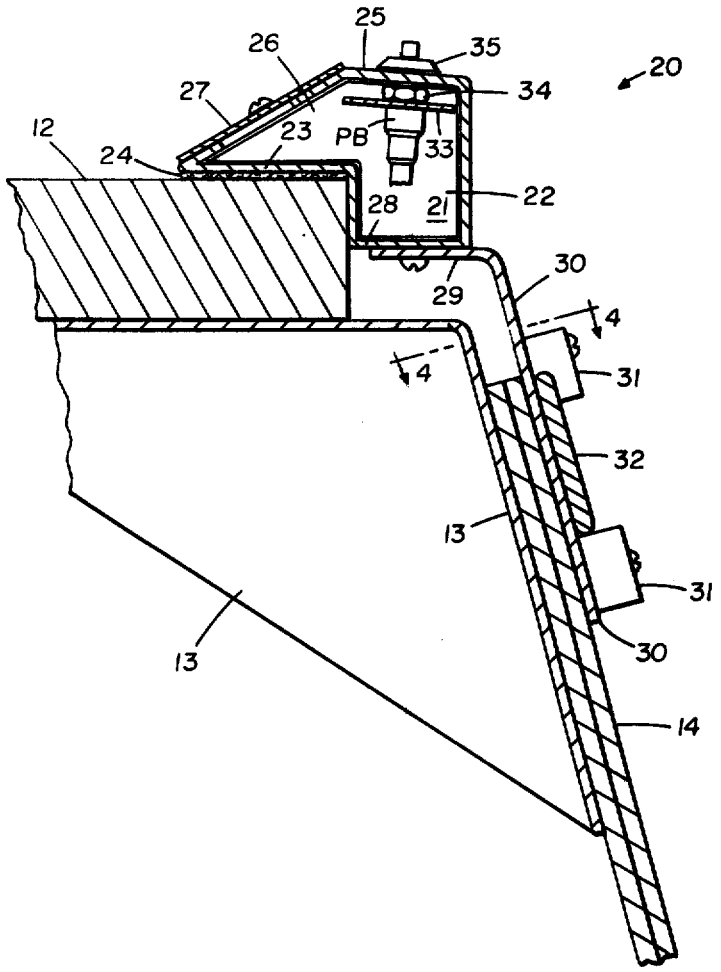
FIG. 3 is a transverse sectional view of the selector control housing itself illustrating its structure and its mounting to the rotary file.

The movable selector controls 20 include an elongated housing 21 formed, as shown, from metal having a pair of closed ends 22. The control housing 21 is stepped to fit over the upper rear edge of the shelf 12 between whose upper surface and the housing upper floor 23 is interposed a felt strip 24 secured to the latter. The forward portion of the housing top wall 25 is inclined and is formed with an opening 26 along its length which is normally closed by a face plate 27 screwed to the end caps 22. To the housing lower floor 28 is screwed the forward edge of a plate 29 along its length which is provided with a rear, downward extension 30 overlapping the file housing wall 14. To each end of the extension 30 are screwed a pair of upper and lower retaining blocks 31 (only one pair being shown in FIG. 3) which embrace a stationary guide bar 32. The latter is screwed at its ends to a pair of spacer blocks 33

Figure 4:
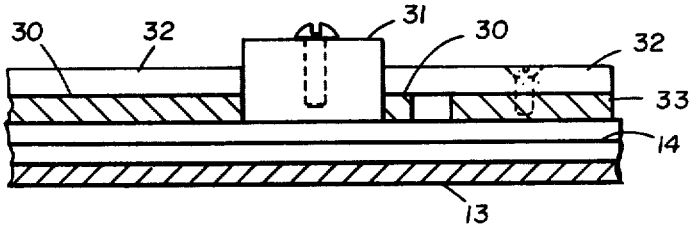
FIG. 4 is a section view taken along the line 4—4 of FIG. 3.

(only one being shown in FIG. 4) so that the guide bar 32 is outset from the rear of the file housing wall 14, the plate extension 30 sliding laterally between the wall 14 and the bar 32. Hence the control housing 21 is retained in position adjacent, and can be slid from side to side along, the rear edge of the shelf 12.

Within the control housing 21 is disposed a series of pushbutton switches PB of the momentary contact type, one for each cradle 11, in the instance shown there being twelve of the latter so that there are switches PBI–12, together with a stop switch SP and a reset switch RS of similar type, and a signal lamp L. All the switches PBI–12 and RS are normally open, while the switch SP is normally closed, and together with the lamp L are mounted in a row to a metal strip 33 by nuts 34. The resulting assembly is placed up under the control housing top wall 25, the pushbuttons of the switches PB1–12, SP and RS and the lamp L passing through apertures in the top wall 25, and secured by exterior nuts 35. The various switches are identified by appropriate indicia placed upon a strip 36 affixed to the face plate 27.

Figure 5:
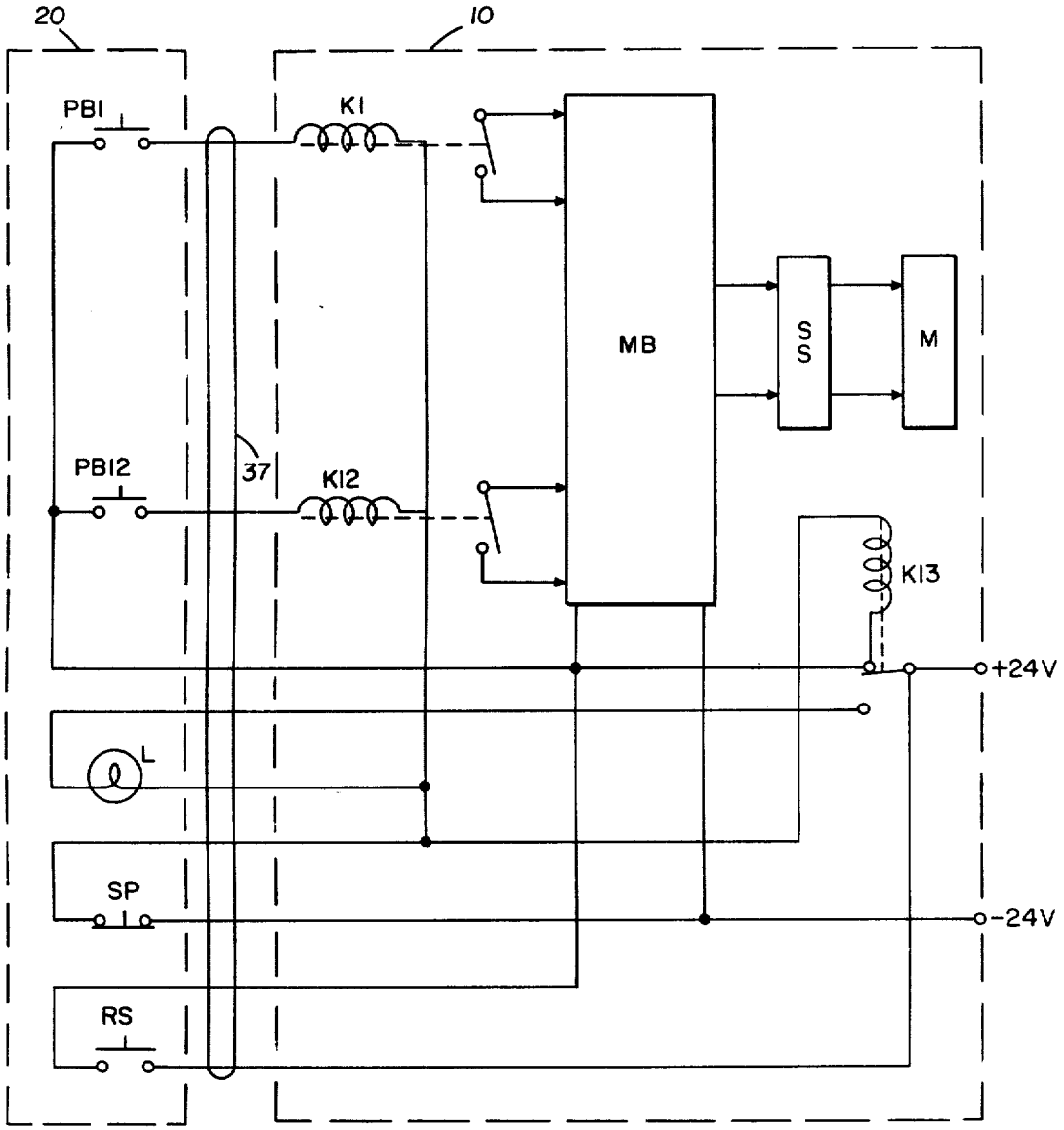
FIG. 5 is an electrical schematic of that portion of the circuitry employed which is concerned with the selector controls themselves.

Inasmuch as the basic electrical circuitry for rotary files of the type concerned is old and well known, only that portion immediately pertinent to the present invention is shown in FIG. 5 and will now be briefly described. Each switch PB1–12 is connected to and energizes one of a respective series of relays K1–12 of the vacuum reed-type which closes a holding circuit in the memory bank MB governing the selector switch SS which in turn controls the motor circuit M to bring the designated cradle 11 into position. The switches PB1–12 and the memory bank MB are energized from an appropraite 24 volt DC power source through the contacts of a relay K13 when the latter is activated. As will be apparent, the solenoid of the relay K13 is in series with the normally closed stop switch SP and a relay holding circuit. Should some unsafe or emergency condition exist, depressing the stop switch SP will drop out the relay K13 and thus de-energize the switches PB1–12, the memory bank MB and the motor circuit M. At the same time, the lamp L will be lit to indicate the abnormal condition. The entire control system will therefore remain shut down until the reset switch RS is closed to re-establish the holding circuit to the relay K13 and power to the pushbutton switches PB1–12, the memory bank MB and the motor circuit M. It will be understood, of course, that the relays K1–12, K13, the memory bank MB, selector switch SS, the motor circuit M and so forth are located within the file housing 10 and connected to the switches PB1–12, SP, RS and the lamp L through an appropriate electrical cable, generally indicated at 37 in FIG. 5, between the file housing

10 and the control housing 21 and disposed behind the file housing wall 14. Since little power is required to activate the relays K1–12, all the switches and wiring at the selector control 20, as well as the cable 37 itself, can be of light duty type and thus small in bulk and weight.

Though the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. In a power driven file of the rotary type having a plurality of elongated record cradles, electric power means for moving the cradles one by one into position along the rear of an elongated operator shelf disposed across the the front of the file for access to records in the cradles, and electric selector control means controlling the power means for moving selected ones of the cradles into said position, a portion of the selector control means being exposed for operation by the operator, the improvement wherein said portion of the selector control means comprises an elongated pushbutton switch housing, means securing the housing along the rear edge of the operator's shelf for movement by and at the option of the operator along a fixed track between the ends of the shelf independently of the position of any of the cradles in the file, the housing carrying a plurality of pushbutton switches of the momentary contact-type with their pushbuttons exposed for operation by the operator, a pair of the switches being effective respectively to cause deactivation and reactivation of the power means independently of the remainder of the switches, the remainder of the switches constituting a group of switches each of which is electrically associated with one of the cradles, all of the switches being connected to a stationary portion of the file by an electrical cable movable with the housing.

2. The file of claim 1 wherein the selector control means includes a plurality of relays of the vacuum reed-type located at a stationary portion of the file and respectively associated with and activated by the switches of said switch group through said cable.

3. The file of claim 1 wherein the securing means comprises a rearwardly extending downturned plate along the housing by which said housing is supported relative to the shelf, and means both attaching the downturned portion of the plate to the file for its slidable movement together with the housing along the shelf rear edge and providing said fixed track.

* * * * *